US012403993B2

(12) United States Patent
Harris

(10) Patent No.: US 12,403,993 B2
(45) Date of Patent: Sep. 2, 2025

(54) PADDLE WITH EXTENDABLE SECOND BLADE

(71) Applicant: Julia Harris, Middlebury, VT (US)

(72) Inventor: Julia Harris, Middlebury, VT (US)

( * ) Notice: Subject to any disclaimer, the term of this patent is extended or adjusted under 35 U.S.C. 154(b) by 58 days.

(21) Appl. No.: 18/040,499

(22) PCT Filed: Sep. 30, 2022

(86) PCT No.: PCT/US2022/077322

§ 371 (c)(1),
(2) Date: Feb. 3, 2023

(87) PCT Pub. No.: WO2023/056404

PCT Pub. Date: Apr. 6, 2023

(65) Prior Publication Data

US 2024/0262479 A1 Aug. 8, 2024

Related U.S. Application Data

(60) Provisional application No. 63/251,265, filed on Oct. 1, 2021.

(51) Int. Cl.
*B63H 16/04* (2006.01)

(52) U.S. Cl.
CPC ..... *B63H 16/04* (2013.01)

(58) Field of Classification Search
CPC ..... B63H 16/04
See application file for complete search history.

(56) References Cited

U.S. PATENT DOCUMENTS 4,302,194 A * 11/1981 Perales ..... B63H 16/04 440/13
2005/0101200 A1* 5/2005 Townsend ..... B63H 16/04 440/101
2011/0027101 A1* 2/2011 Hartman ..... B63H 16/04 416/70 R
2012/0164897 A1* 6/2012 Udell ..... B63C 7/003 440/101
2017/0142946 A1* 5/2017 Lockwood ..... B63H 16/04

FOREIGN PATENT DOCUMENTS

GB 2201389 A 9/1988
GB 2225759 A * 6/1990 ..... B63H 16/04

OTHER PUBLICATIONS

Matos, Tania, "Written Opinion of the International Search Authority," Jan. 12, 2023.

* cited by examiner

*Primary Examiner* — S. Joseph Morano
*Assistant Examiner* — Jovon E Hayes
(74) *Attorney, Agent, or Firm* — Downs Rachlin Martin PLLC

(57) ABSTRACT

A self-contained paddle can be adjusted from a single paddle form with a handle on one end to a double paddle configuration having paddle blades on both ends. The paddle of the present invention allows for the handle end of a water recreation paddle to transform to a second paddle, forming a double paddle without bring a separate attachment during an outing and without interfering with the use of the paddle in the single paddle configuration when the paddle is in the single paddle configuration.

13 Claims, 5 Drawing Sheets

PADDLE WITH EXTENDABLE SECOND BLADE

FIELD OF THE INVENTION

The present invention generally relates to paddles for water recreation. In particular, the present invention is directed to a water recreation paddle with an extendable second blade.

BACKGROUND

When paddling on watercraft, such as paddleboards, a user is often standing and so requires a relatively long-handled paddle with a handle on one end and a blade on the other.

SUMMARY OF THE DISCLOSURE

A paddle having a single paddle configuration and a double paddle configuration includes a shaft having a first end and a second end, a first blade on the first end of the shaft, a handle on the second end of the shaft when the paddle is in the single paddle configuration, an inner shaft having a shaft end and a handle end, wherein the inner shaft is attached at the handle end to the handle and contained within the shaft when the paddle is in the single paddle configuration, and a second blade attached to the inner shaft and having a compact configuration and an extended configuration. The handle is disconnected from the shaft and the inner shaft is extended outwardly from and connected at the shaft end to the shaft when the paddle is in the double paddle configuration and the second blade is in the extended configuration when the paddle is in the double paddle configuration.

Additionally or alternatively, the inner shaft includes an opening running along a side and a support rod is attached within the inner shaft.

Additionally or alternatively, the second blade includes a first edge attached to the support rod, a second edge attached to an edge support member, and a support member pivotably attached to the edge support member on one end and releasably attached to the inner shaft to secure the second blade in the extended configuration.

Additionally or alternatively, the second blade further includes woven fabric and a plurality of stays.

Additionally or alternatively, the edge support member is pivotably attached to the support rod.

In another aspect of the invention, a paddle having a single blade configuration and a double blade configuration includes an extendable shaft having a first segment and a second segment, wherein a portion of the second segment is configured to slidably fit within the first segment, a first blade on a first end of the first segment, a handle on a first end of the second segment when the paddle is in the single blade configuration, an inner shaft having a shaft end and a handle end, wherein the inner shaft is attached at the handle end to the handle and contained within the second segment when the paddle is in the single blade configuration, and a second blade attached to the inner shaft and having a compact configuration and an extended configuration. The handle is disconnected from the first end of the second segment and the inner shaft is extended outwardly from and connected at the shaft end to the second segment when the paddle is in the double blade configuration and the second blade is extendable to the extended configuration when the paddle is in the double blade configuration.

Additionally or alternatively, the inner shaft includes an opening running along a side and a support rod is attached within the inner shaft.

Additionally or alternatively, the second blade includes a first edge attached to the support rod, a second edge attached to an edge support member, and a support member pivotably attached to the edge support member on one end and releasably attached to the inner shaft to secure the second blade in the extended configuration.

Additionally or alternatively, the second blade further includes woven fabric and a plurality of stays.

Additionally or alternatively, the edge support member is pivotably attached to the support rod.

In another aspect of the invention, a method for converting a single blade paddle to a double blade paddle includes detaching a handle from a first end of a shaft of a paddle, wherein the paddle includes a first blade on a second end, extending the detached handle outward from the shaft such that an inner shaft contained within the shaft and attached to the handle on a first end is exposed, securing the inner shaft in an extended position, unfurling a second paddle from a compact configuration within the inner shaft to an extended configuration, and securing a first end of a support member to the inner shaft. A second end of the support member is attached to a first end of a second support member, a second end of the second support member is attached to the inner shaft, a first edge of the second paddle is attached to the inner shaft and a second edge of the second paddle is attached to the second support member.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

A user on a recreation watercraft such as a paddleboard may switch from a standing position to a kneeling or sitting position, depending on the conditions, for example. In a standing position, the user paddles with a long paddle having a handle on one end and a blade on the other end. In a seated or kneeling position, such a paddle can be cumbersome and inefficient to use. In that situation, a double paddle would be more desirable to use. However, for many users on most recreational watercraft that are mostly paddled, stowing two paddles is undesirable. Similarly, bringing along a double paddle attachment may be inconvenient because, if remembered, it can fall off the watercraft (or would have to be secured in some way that could interfere with the use of the watercraft).

Thus, there is a need for a self-contained paddle that can be adjusted from a single paddle form with a handle on one end to a double paddle configuration having blades on both ends. The paddle of the present invention allows for the end of the shaft having the handle to transform to a second blade, forming a double paddle without the need to bring a separate attachment during an outing and without interfering with the use of the paddle in the single paddle configuration when the paddle is in the single paddle configuration.

Figure 1A:
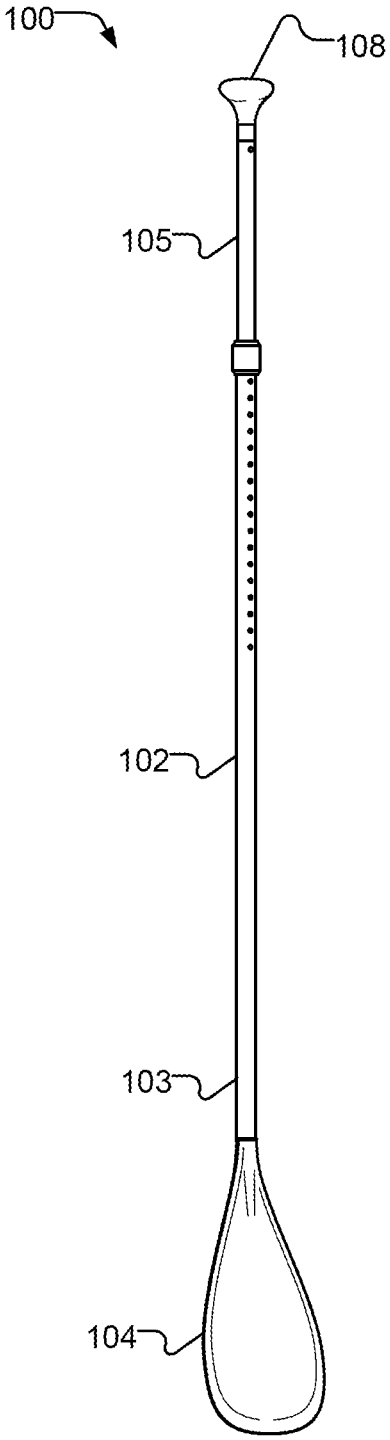
FIG. 1A is a perspective view of a paddle in a single paddle configuration in accordance with an embodiment of the present invention.
Figure 1B:
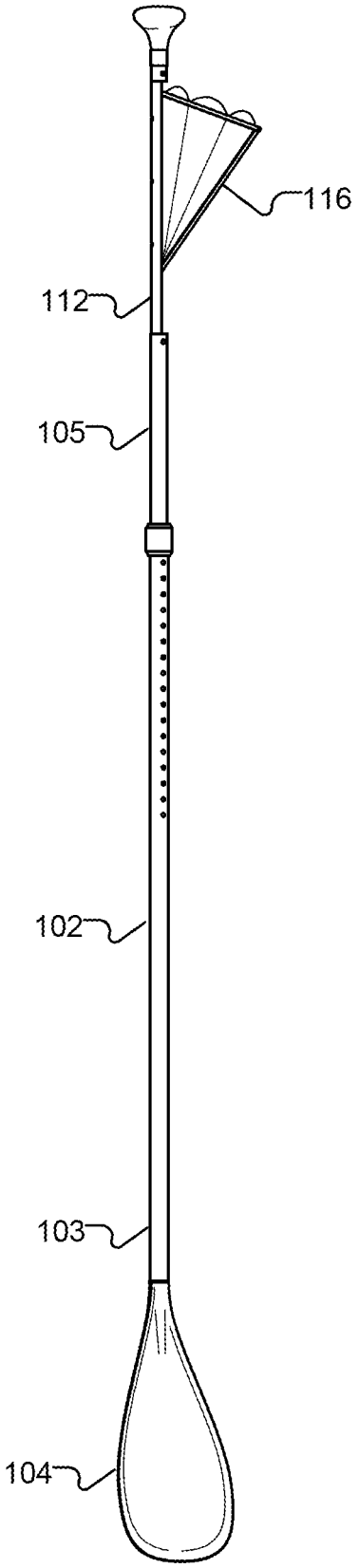
FIG. 1B shows the paddle of FIG. 1 in a double paddle configuration in accordance with an embodiment of the present invention.
Figure 2A:
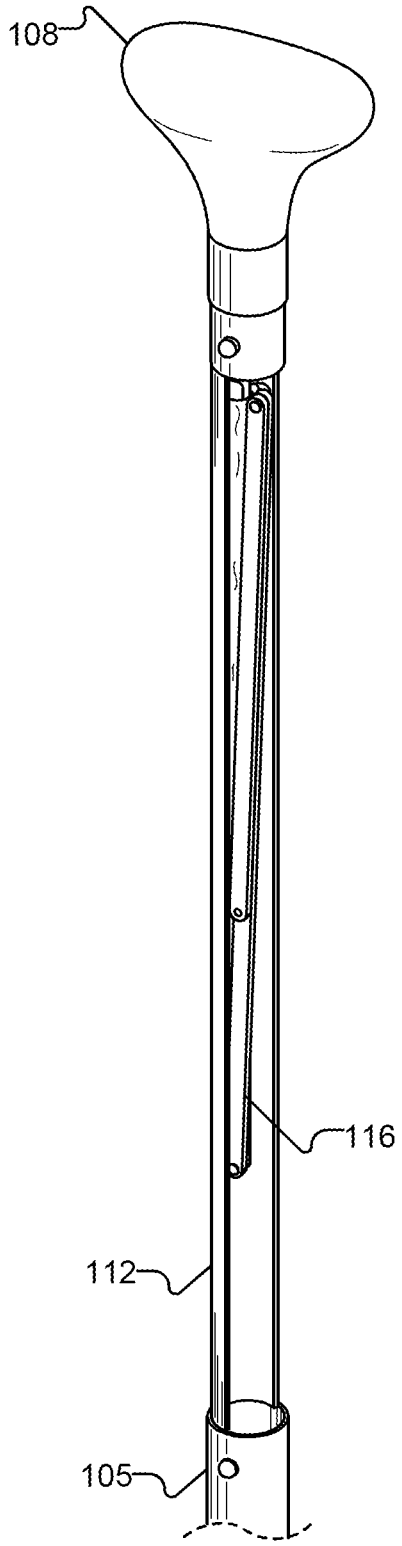
FIG. 2A is a detailed view of the second blade portion of the paddle of FIG. 1B in which the handle is extended and the blade is stowed.
Figure 3:
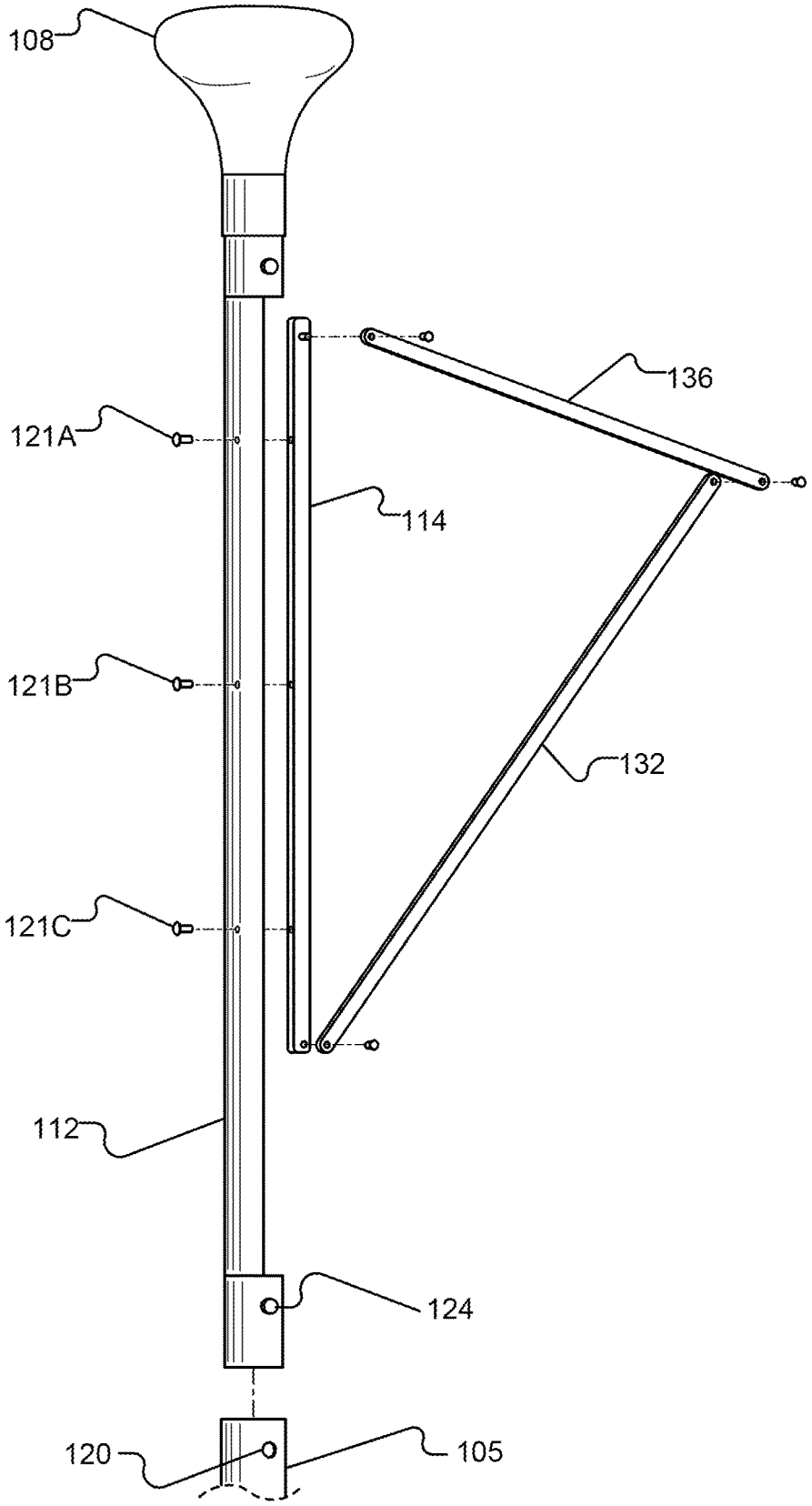
FIG. 3 is an exploded, detailed view of the portion shown in FIG. 2A in which the blade webbing is removed.

The paddle includes a single paddle configuration as shown in FIG. 1A. Paddle 100 includes a shaft 102 having a lower shaft 103 and an upper shaft 105. Lower shaft 103 and upper shaft 105 may be slidably engaged to allow for the adjustment of the overall length of shaft 102. A first blade 104 is on one end of lower shaft 103 and a handle 108 on one end of upper shaft 105. Handle 108 may be loosened from the end of upper shaft 105 and extended outwardly revealing an embedded inner shaft 112 which has a second blade 116 attached in a compressed state (as shown in FIG. 2A) that can be placed in an unfurled state to form a double paddle configuration as shown in FIG. 1B. Inner shaft 112 may be cylindrical with an opening running along one side, such as a ½ or ¾ cylinder (as best seen in FIG. 2A), which houses a folded or compressed second blade 116 when in a stowed position, as when inner shaft 112 is within upper shaft 105. Inner shaft 116 may be secured in the extended position by any suitable mechanism, such as a hole 120 for receiving a depressible securing knob 124. Once inner shaft is extended and secured in the extended position, second blade 116 may be unfurled and secured into a blade form. Preferably, a rod 114 or other support member may be attached to an inner portion of inner shaft 112, such as by rivets 121 (e.g., 121A-121C as shown in FIG. 3). In an embodiment, second blade 116 may be made of woven fabric or other suitable material with a plurality of supports 128 (e.g., 128A-128B) at intervals for added rigidity.

Figure 2B:
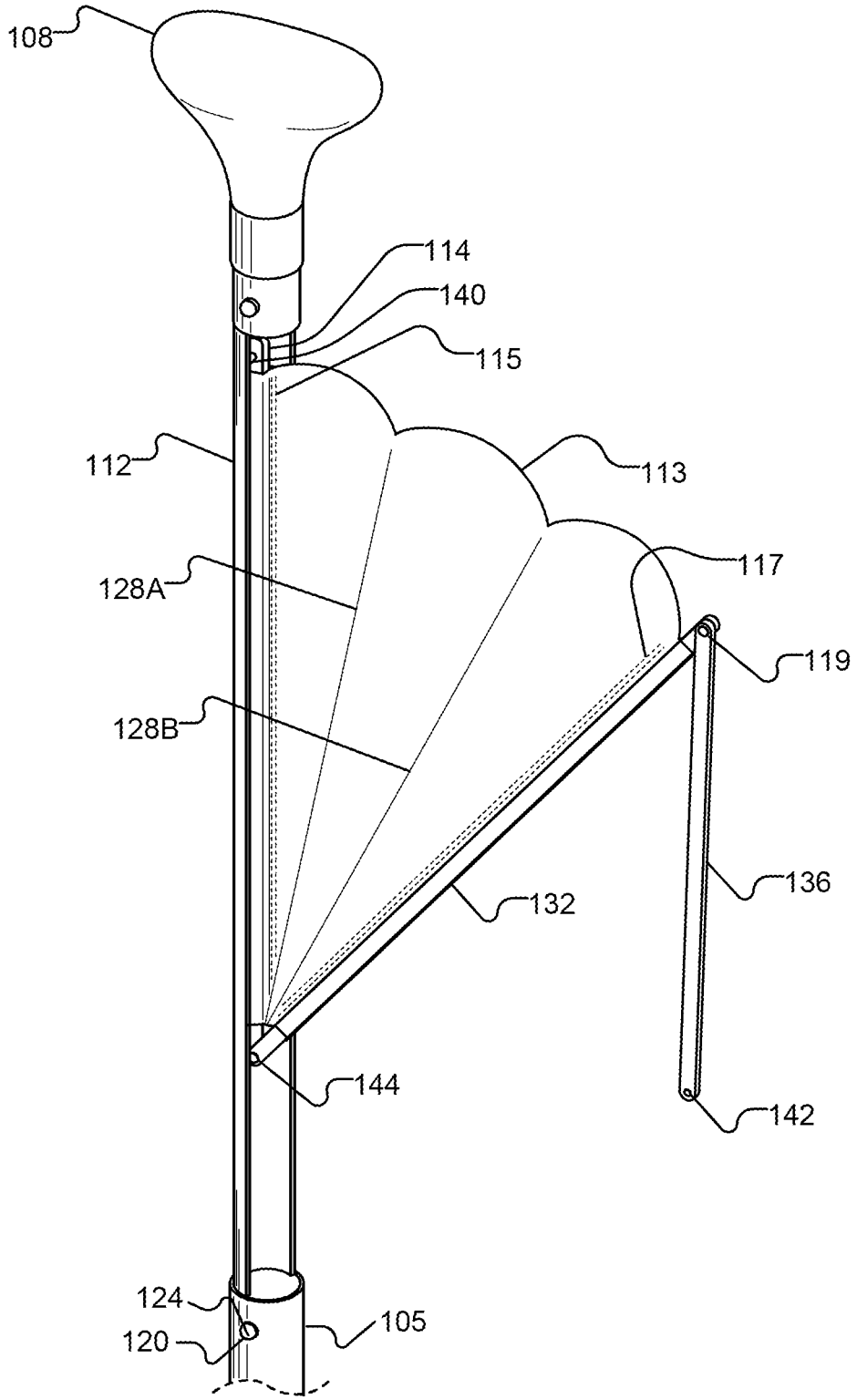
FIG. 2B is the detailed view of the portion shown in FIG. 2A in which the second blade is unfurled and locked in position.
Figure 2C:
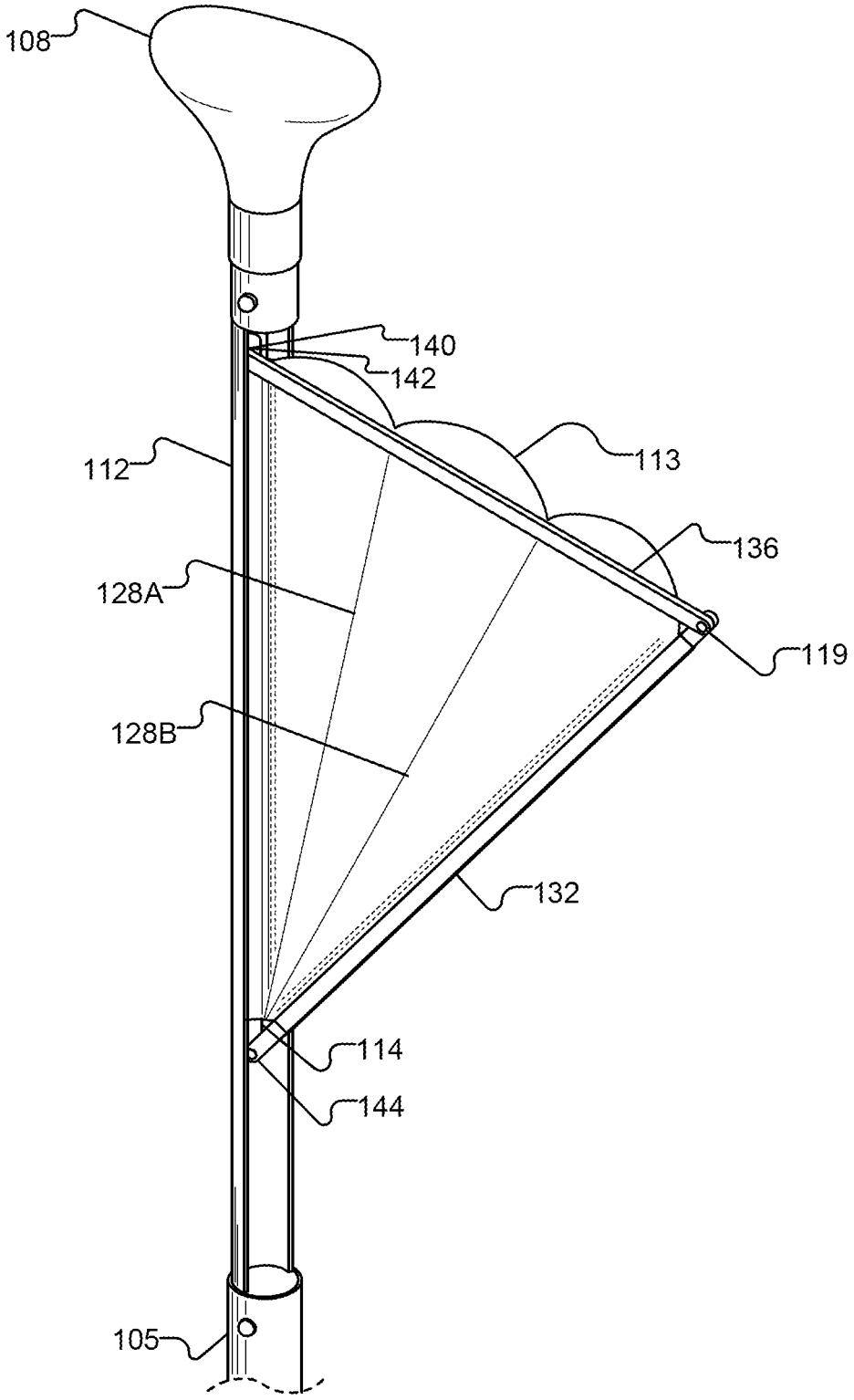
FIG. 2C is the detailed view of the portion shown in FIG. 2A in which the second blade is unfurled and locked in position.

Turning to FIGS. 2B-3, a first edge 115 of second blade 116 is attached, such as by a sewn seam, to rod 114 and a second edge 117 is attached, such as by a sewn seam, to an outer edge support member 132. Outer edge support member 132 is pivotably attached to rod 114 or inner shaft 112 at a pivot point 44 and may include a pivotably attached blade support 136 that is attached on one end to the distal end of outer edge support member 132 and can be pivoted around pivot point 119 so that blade support 136 extends along an outside edge 113 of second blade 116 and engages, via a female snap 142 or other suitable mechanism, with a male snap 140, socket, or other suitable receptor on inner shaft 112 that can reversibly secure the other end of blade support 136 in position to maintain second blade 116 in an unfurled configuration. Other securement mechanisms may be used to maintain second blade 116 in a blade shape for use when paddle 100 is in the double paddle configuration.

In this way, a single ended long paddle for a "standup" paddleboard has an extendable shaft with an enclosed second blade that can be deployed so that the paddle becomes a double paddle. Note that the shaft of the paddle may also be adjustable in length, which is beneficial for both single paddle uses and double paddle uses.

The adjustable handle at the end of the single paddle configuration allows for standard use of single long paddle with handle, which can be converted to a double ended paddle by unlocking shaft and extending secondary blade, which was folded inside shaft. Once secured in place this would allow for double ended use. To transform back to a single paddle configuration, the securement mechanism would be released and the flexible material folded back into main shaft and the handle resecured in place at the end of the shaft.

The folded webbing used for the collapsible and stowable secondary blade may be made of various materials in addition to a woven fabric such as rip stop nylon or a plastic with a frame and support stays of aluminum or any other suitable light and supportive material.

Exemplary embodiments have been disclosed above and illustrated in the accompanying drawings. It will be understood by those skilled in the art that various changes, omissions, and additions may be made to that which is specifically disclosed herein without departing from the spirit and scope of the present invention.

What is claimed is:

1. A paddle having a single paddle configuration and a double paddle configuration comprising:

a shaft having a first end and a second end;

a first blade on the first end of the shaft;

a handle on the second end of the shaft when the paddle is in the single paddle configuration;

an inner shaft having a shaft end, a handle end, and an opening running along a length between the shaft end and the handle end, wherein the inner shaft is attached at the handle end to the handle and contained within the shaft when the paddle is in the single paddle configuration; and a second blade attached to the inner shaft and having a compact configuration and an extended configuration, wherein the second blade fits within the inner shaft when in the compact configuration, wherein, when the paddle is in the double paddle configuration, the inner shaft extends outwardly from and is connected at the shaft end to the shaft, and the second blade extends outwardly from the opening of the inner shaft to form the extended configuration.

2. The paddle of claim 1, wherein a support rod is attached within the inner shaft.

3. The paddle of claim 2, wherein the second blade includes a first edge attached to the support rod, a second edge attached to an edge support member, and a support member pivotably attached to the edge support member on one end and releasably attached to the inner shaft to secure the second blade in the extended configuration.

4. The paddle of claim 3, wherein the second blade further includes woven fabric and a plurality of stays.

5. The paddle of claim 3, wherein the second blade further includes nylon material.

6. The paddle of claim 3, wherein the edge support member is pivotably attached to the support rod.

7. A paddle having a single blade configuration and a double blade configuration comprising:

an extendable shaft having a first segment and a second segment, wherein a portion of the second segment is configured to slidably fit within the first segment;

a first blade on a first end of the first segment;

a handle on a first end of the second segment when the paddle is in the single blade configuration;

an inner shaft having a shaft end and a handle end, wherein the inner shaft is attached at the handle end to the handle and contained within the second segment when the paddle is in the single blade configuration; and a second blade attached to the inner shaft and having a compact configuration and an extended configuration, wherein the second blade fits within the inner shaft when in the compact configuration, wherein, when the paddle is in the double blade configuration, the inner shaft extends outwardly from and is connected at the shaft end to the second segment, and the second blade extends outwardly from the inner shaft to form the extended configuration while the handle remains attached to the handle end of the inner shaft.

8. The paddle of claim 7, wherein the inner shaft includes an opening running along a side and a support rod is attached within the inner shaft.

9. The paddle of claim 8, wherein the second blade includes a first edge attached to the support rod, a second edge attached to an edge support member, and a support member pivotably attached to the edge support member on one end and releasably attached to the inner shaft to secure the second blade in the extended configuration.

10. The paddle of claim 9, wherein the second blade further includes a woven fabric material and a plurality of stays.

11. The paddle of claim 9, wherein the edge support member is pivotably attached to the support rod.

12. A method for converting a single blade paddle to a double blade paddle comprising:

detaching a handle from a first end of a shaft, wherein the shaft includes a first blade on a second end of the shaft;

extending the detached handle outward from first end of the shaft such that an inner shaft contained within the shaft and attached to the handle on a first end of the inner shaft is in an extended position;

securing, at the first end of the shaft, the inner shaft in the extended position; and unfurling a second blade from a compact configuration within the inner shaft to an extended configuration.

13. The method of claim 12, wherein unfurling the second blade includes pivoting a first end of a first support member outwardly from the inner shaft, wherein the first support member is attached to a first edge of the second blade, and securing a first end of a second support member to the inner shaft, wherein the second support member is attached to a second edge of the second blade and pivotably attached to a second end of the first support member.

* * * * *